US005529303A

United States Patent [19]

Chen

[11] Patent Number: 5,529,303

[45] Date of Patent: Jun. 25, 1996

[54] GOLF CLUB HEAD

[75] Inventor: Yih-Chung Chen, Tainan Hsien, Taiwan

[73] Assignee: Cherng Horng Metal Industry Corp., Tainan Hsien, Taiwan

[21] Appl. No.: 492,566

[22] Filed: Jun. 20, 1995

[51] Int. Cl.[6] ..... A63B 53/04

[52] U.S. Cl. ..... 473/327

[58] Field of Search ..... 273/167 R, 167 E, 273/193 R, 186.2, 187.4, 167 H

[56] References Cited

U.S. PATENT DOCUMENTS

| | | | |
|---|---|---|---|
| 976,176 | 11/1910 | Hollingsworth | 273/193 R |
| 2,111,249 | 3/1938 | Plese | 273/193 R |
| 4,809,982 | 3/1989 | Kobayashi | 273/167 E |
| 5,054,784 | 10/1991 | Collins | 273/167 E |
| 5,158,296 | 10/1992 | Lee | 273/167 E |
| 5,271,622 | 12/1993 | Rogerson | 273/167 E |

*Primary Examiner*—Sebastiano Passaniti

*Attorney, Agent, or Firm*—Morton J. Rosenberg; David I. Klein

[57] ABSTRACT

A golf club head has a plurality of small air holes in a striking face, an air guide through hole communicating with the small air holes and extending through the interior of the head laterally to open to an opposite side of the striking face. A vertical hole extends upright from the sole of the head to communicate with the guide air, a spring, a round bar bored with a center hole, and a screw are orderly fitted in the vertical hole. The screw is able to be screwed inward or outward to push the round bar inward or outward to let the area of the center hole communicating with the air guide through hole change so as to alter the air volume or speed passing through the air guide hole and thus reduce air resistance of the striking face.

2 Claims, 2 Drawing Sheets

GOLF CLUB HEAD

BACKGROUND OF THE INVENTION

This invention relates to a golf club head, particularly able to be adjusted in the air volume or speed to flow through a striking face and through the head to flow out during swinging a golf club, and consequently reducing air resistance of the striking face.

As the standard of living has been elevated, various exercises and sports have become very popular, especially golf. Accordingly many kinds of golf club heads are on market and in use, but some of them have disadvantages as follows:

1. A solid golf club head has an air resistance on a striking face, giving instant negative influence to striking speed.

2. A solid golf club head has a rather heavy weight, in addition to air resistance of a striking face, making up inconvenience to a golfer in swinging the golf club.

SUMMARY OF THE INVENTION

This invention has been devised to offer a kind of golf club head having a rather light weight and an air guide through hole laterally provided to extend from a plurality of small air holes in the striking face to an opposite side of the striking face so that air can flow through the small air holes and the air guide through hole and out of the head, and consequently reducing air resistance of the striking face of the head during swinging a golf club.

BRIEF DESCRIPTION OF DRAWINGS

The invention will be better understood by reference to the accompanying drawings, wherein.

DESCRIPTION OF THE PREFERRED EMBODIMENTS

Figure 1:
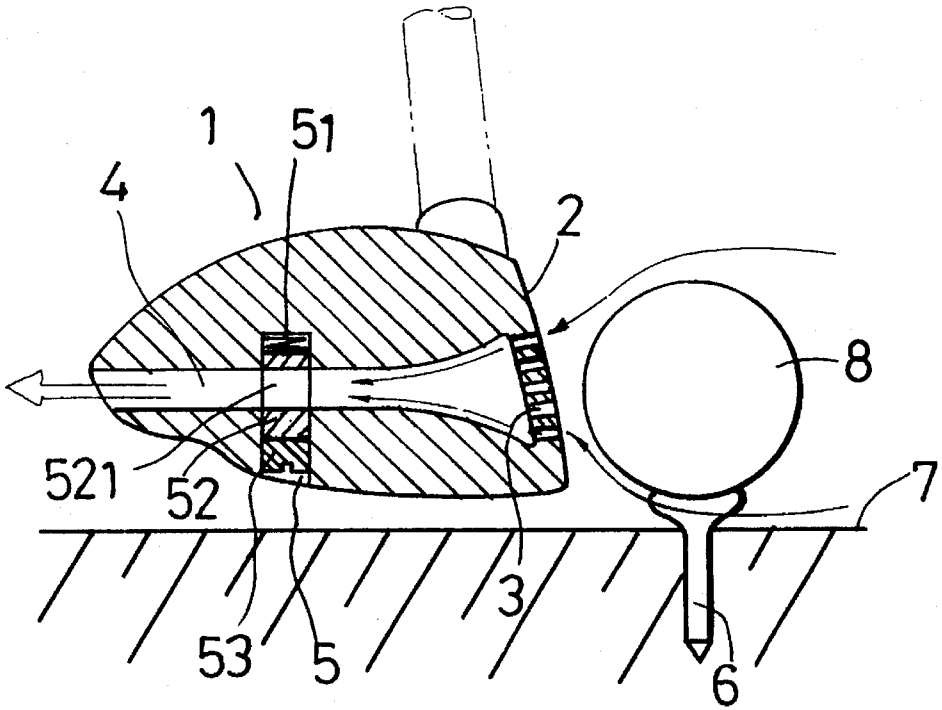
FIG. 1 is a cross-sectional view of a golf club head in the present invention.
Figure 2:
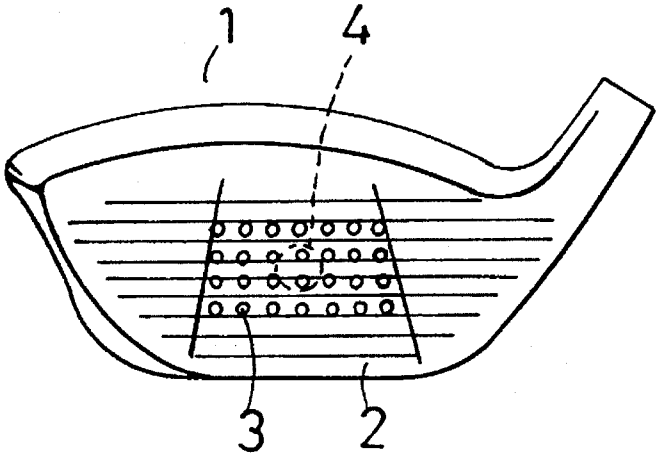
FIG. 2 is a side view of the golf club head in the present invention.
Figure 3:
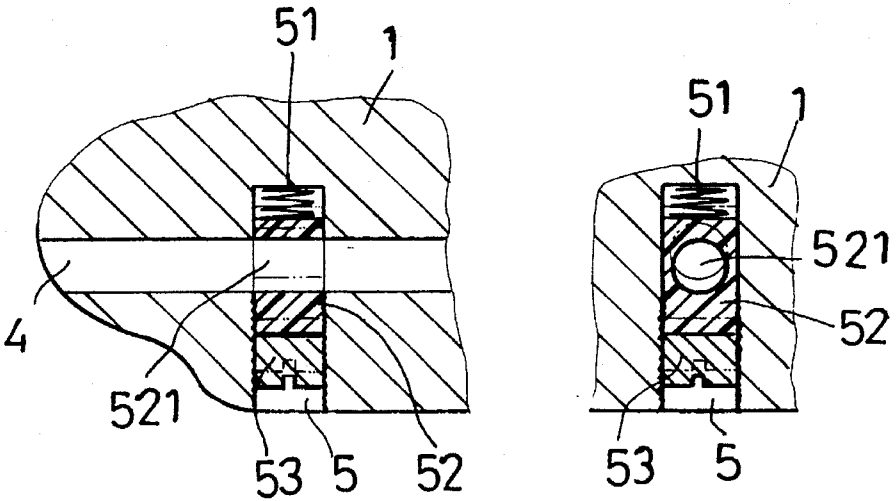
FIG. 3 is a part cross-sectional view of the golf club head in the present invention, showing a spring, a round bar and a screw orderly fitted in a vertical hole in a sole of the head; and, FIG. 4 is a cross-sectional view of a second embodiment of the golf club head in the present invention.

A first embodiment of a golf club head in the present invention, as shown in FIGS. 1 and 2, includes a striking face 2, a plurality of small air holes 3 provided in a sweet area of the striking face 2, and an air guide through hole 4 laterally provided through the head 1 and communicating with the plurality of the small air holes 3 and to open to an opposite side of the striking face so that air flowing into the small air holes 3 may flow through the air guide through hole 4 out of the opposite side into outside open air. But it is important that the small air holes 3 have a depth enough for enduring striking force of a golf ball as the air guide through hole 4 directly follows them. The head further has a vertical hole 5 in a sole to communicated with the air guide through hole 4, a spring 51, a round short bar 52 bored with a center hole 521 and an adjusting screw 53 being orderly fitted in the vertical hole 5.

When the golf club head 1 described above is swung to hit a golf ball 8 put on a peg tee 6 on the ground 7, air will flow through the small air holes 3 into the guide through hole 4 of the club head 1 and out of the opposite side into open air. The location of the round bar 52 in the vertical hole 5 can be altered by the adjusting screw 53 driven with a screw driver so that the area of the center hole 521 of the round bar 52 communicating with the air guide through hole 4 may be changed to allow different volume of air to pass through, in other words, the air speed passing through the air guide through hole 4 can be adjusted by means of the adjusting screw 53 in swinging a golf club and striking a golf ball.

Figure 4:
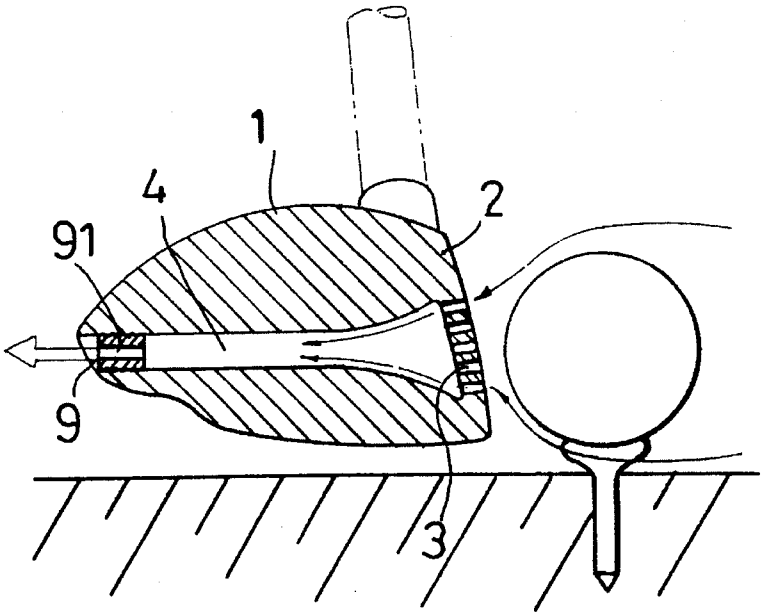

A second embodiment of the golf club head 1 in the present invention, as shown in FIG. 4, further has an adjusting male-threaded block 9 added to the first embodiments. The adjusting male-threaded block 9 has a center hole 91 to engage in a left end of the air guide through hole 4, and a plurality of the blocks 9 with the center hole 91 of different diameters are prepared to be selectably used to engage the left end of the air guide through hole 4 so as to change the air volume passing through the air guide hole 4.

So it is evident that the golf club head in the present invention has advantages as follows:

1. The air volume passing through the air guide through hole of the club head, or the speed of the air passing therethrough, can be adjusted according to a user's custom or feeling in striking a golf ball, by adjusting the screw 53 and/or the adjusting block 9.

2. The small air holes 3 in the striking face 2 can permit air to pass therethrough and the air guide through hole 4 during striking a golf ball by the head 1, reducing air resistance of the head 1 in a proper degree.

3. Instant striking speed of the head can be elevated greatly, obtaining effect based on the scientific theory, as the air resistance of the striking face is reduced.

4. A golfer can swing the golf club smoothly and easily by means of the small air hole communicating with the air guide through hole in the head, in addition to increased speed of the golf ball.

5. The depth of the small air holes is made enough to endure the striking force of a golf ball against the head, without possibility of breaking the striking face.

While the preferred embodiments of the invention have been described above, it will be recognized and understood that various modifications may be made therein and the appended claims are intended to cover all such modifications which may fall within the spirit and scope of the invention.

What is claimed is:

1. A golf club head comprising a club head body having a striking face having a sweet spot area, a side opposite to said striking face and defining a rear of said head and a sole, said sweet spot area having a plurality of small air holes, an air guide through hole communicating with said small air holes and passing through laterally in said head to open to said side opposite to said striking face, said air guide through hole including an upper surface, a vertical hole in said sole extending upright to communicate with said air guide through hole and having an upper end surface disposed generally higher than said upper surface of said air guide through hole, a spring disposed in said vertical hole adjacent said upper end surface, a round bar member disposed within said vertical hole adjacent said spring, said round bar member having a centrally disposed hole communicating with said air guide through hole, a screw member threadedly engaged within said vertical hole to displace said round bar member against a bias force of said spring and thereby vary an area dimension of said centrally disposed hole of said round bar member in open communication with said air guide through hole for adjusting an air volume passing from said plurality of small air holes through said air guide through hole to said rear of said head to reduce air resistance of said striking face of said head during swinging of a golf club.

2. The golf club head as recited in claim 1 further comprising a plurality of male-threaded blocks, each of said male-threaded blocks having a hole formed centrally therethrough of a diameter that differs from one male-threaded block to another, one of said male-threaded blocks being selected for engagement within an end of said air guide through hole for changing said air volume passing therethrough.

* * * * *